US005345697A

United States Patent [19]

Quellais

[11] Patent Number: 5,345,697

[45] Date of Patent: Sep. 13, 1994

[54] BOOT TIGHTENED BY A FLEXIBLE LINK

[75] Inventor: Jacques Quellais, Saint-Jorioz, France

[73] Assignee: Salomon S.A., Metz-Tessy, France

[21] Appl. No.: 52,726

[22] Filed: Apr. 27, 1993

[30] Foreign Application Priority Data

Nov. 6, 1992 [FR] France ..... 92 13569

[51] Int. Cl.[5] ..... A43B 11/00; A43C 5/00

[52] U.S. Cl. ..... 36/50.1; 24/712

[58] Field of Search ..... 36/50.1, 50.5; 24/712.5, 712.6, 712.7, 713.4, 713.6, 713.9, 714.6, 712

[56] References Cited

U.S. PATENT DOCUMENTS

| | | | |
|---|---|---|---|
| Re. 31,052 | 10/1982 | Adams . | |
| 49,854 | 9/1865 | Burchardt | 24/712.5 |
| 340,557 | 4/1886 | Comins | 24/712.6 |
| 752,172 | 2/1904 | Manss | 36/50.1 |
| 1,067,323 | 7/1913 | Dresler | 24/712.5 |
| 1,159,397 | 11/1915 | Leonard | 24/712.7 |
| 3,545,106 | 12/1970 | Martin | 36/50 |
| 3,975,838 | 8/1976 | Martin | 36/50 |
| 4,142,307 | 3/1979 | Martin | 36/50 |
| 4,200,998 | 5/1980 | Adams . | |
| 4,408,403 | 10/1983 | Martin | 36/54 |
| 4,538,367 | 9/1985 | Adams . | |
| 4,559,723 | 12/1985 | Hamy et al. | 36/50.1 |
| 4,780,969 | 11/1988 | White, Jr. . | |
| 4,817,303 | 4/1989 | Selbiger | 36/50.1 |
| 4,899,466 | 2/1990 | Skaja . | |
| 4,999,889 | 3/1991 | Le Couturer | 24/713.2 |
| 5,129,130 | 7/1992 | Lecouturier | 24/712.6 |
| 5,158,428 | 10/1992 | Gessner et al. | 36/50.1 |
| 5,189,818 | 3/1993 | Skaja . | |
| 5,214,863 | 6/1993 | Skaja . | |

FOREIGN PATENT DOCUMENTS

| | | | |
|---|---|---|---|
| 0114088 | 11/1941 | Australia | 24/713.6 |
| 194277 | 5/1907 | Fed. Rep. of Germany | 24/712.6 |
| 1943299 | 5/1966 | Fed. Rep. of Germany . | |
| 265068 | 9/1968 | Fed. Rep. of Germany | 24/713.6 |
| 87901099 | 9/1989 | Fed. Rep. of Germany . | |
| 90163257 | 8/1991 | Fed. Rep. of Germany | A43C 11/20 |
| WO85/00959 | 3/1985 | PCT Int'l Appl. . | |
| 120244 | 11/1947 | Sweden | 24/712.5 |
| 2021383 | 12/1979 | United Kingdom . | |

*Primary Examiner*—Steven N. Meyers
*Attorney, Agent, or Firm*—Sandler Greenblum & Bernstein

[57] ABSTRACT

A boot having an external sole on which is mounted an upper open towards to the front, to enable passage of the foot and including to this end, an internal and an external quarter connected to each other by a closure system which includes a flexible link along a predetermined alternative path, a series of return elements located in a fixed manner on each side of the quarters in the vicinity of their respective edges located across from each other and defining a lacing zone, such that when an action is exerted on the two free ends (A, B) of the slack ends of the flexible link via traction members, such members tighten quarters, via return elements, so as to bring them closer to one another and consequently ensure internal retention of the foot, wherein the lacing zone can be broken down into three tightening sectors, i.e., a first primary tightening sector; a second primary tightening sector; and a third secondary tightening sector whose tightening is undertaken after that of the first and second sectors by the progressive transmission of traction forces exerted on the slack ends of the flexible link from their free ends.

15 Claims, 3 Drawing Sheets

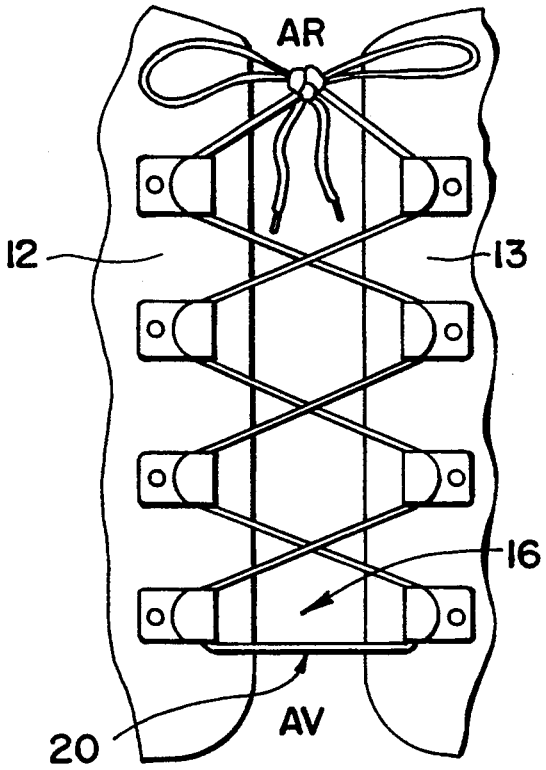
Fig- 1
PRIOR ART
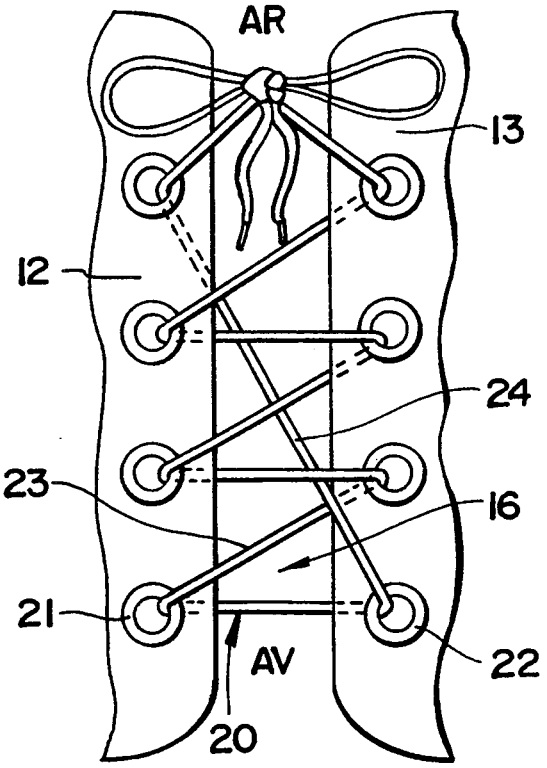
Fig- 2
PRIOR ART
Fig - 3
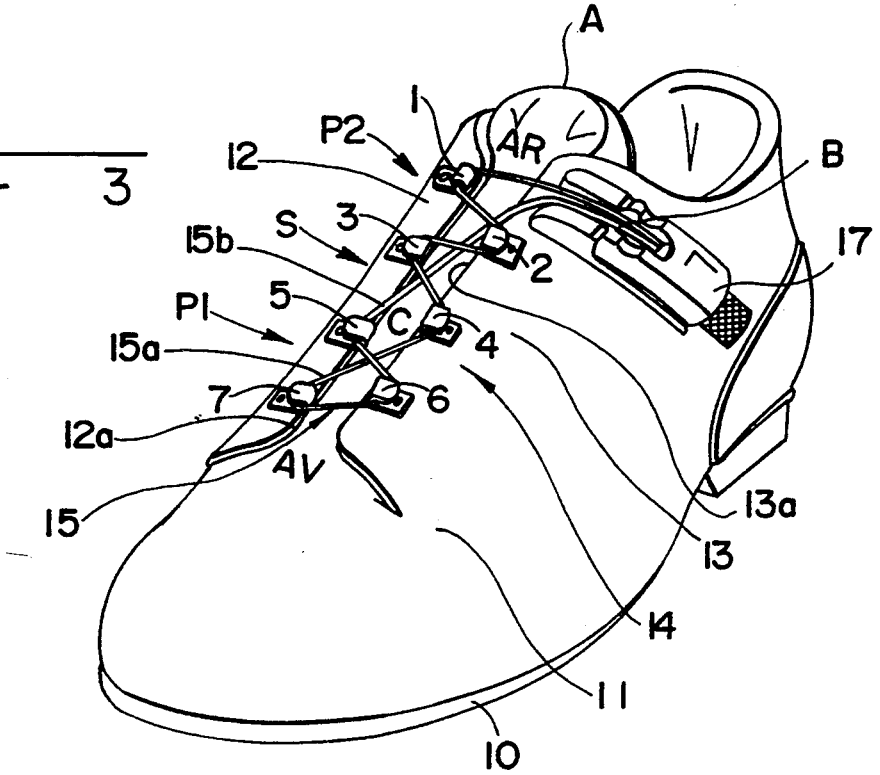

BOOT TIGHTENED BY A FLEXIBLE LINK

BACKGROUND OF THE INVENTION

1. Field of the Invention

The present invention is related to a boot, especially a sports boot, comprising an external sole on which is mounted an upper, open frontwardly to enable passage of the foot, and comprising to this end, an internal quarter and an external quarter connected to each other by a closure system, comprising a lace or cable, along a predetermined alternative path, a series of return elements located in a fixed manner on either side of said quarters in the vicinity of their respective edges located across from each other, and defining a lacing zone, such that when a tractional action is exerted on the two free ends of the slack ends of the lace or cable, such lace or cable tightens the quarters, by means of the return elements, to bring them closer to one another and consequently ensures foot retention.

2. Discussion of Background and Relevant Information

In known sports boots of this type, lacing is done, for example (see illustration of FIG. 1) according to a traditional method consisting of regularly crossing each of the slack ends of lace 20 after passing them through eyelets or behind studs located across from each other on each of quarters 12, 13 of the upper, in a uniform sequence from the front (AV) towards the rear (AR) of the boot.

Another very common method (see illustration of FIG. 2) consists of passing one of the slack ends 24 of lace 20, directly from a first eyelet 21 of one of the quarters 12 of the upper, located towards the rear, to a last eyelet 22 of the other quarter 13 of the upper, located towards the front. In this case, it is the other slack end 23 of the lace which joins all the other eyelets or studs by zig-zagging from one quarter to the other of the upper along the entire length of the lacing zone to make such quarters 12, 13 to come closer together.

Although these lacing methods are satisfactory for boots having a short lacing zone, such is not the case when this lacing zone becomes longer, as for example in climbing boots, cross-country ski boots or other boots adapted for playing basketball, all of which require substantial foot retention, and therefore a longer tightening zone.

In these cases, the above cited methods have a major disadvantage, because when the lacing is long, the traction on the zig-zagging slack end(s) must be even greater since the latter are numerous. In addition, it is impossible to control tightening in order to ensure good distribution along the entire length of the lacing zone.

To overcome this, the user must tighten his boot, not by exerting a traction on the free ends of the slack ends of the lace, but by intervening directly on each of the loops formed by the lace between two eyelets or studs located across from each other, and tighten these loops successively, one after the other until the last eyelets located towards the front portion of the boot. It is possible, that this tightening can be done by action on every other loop, but at any rate, the definitive tightening of the laces of each boot is both long and time consuming.

SUMMARY OF THE INVENTION

An object of the present invention is to overcome these disadvantages by providing a lacing device enabling, by a single action undertaken simultaneously on the free ends of the slack ends of the lace or cable, to obtain an easy tightening distributed in a controlled manner, uniformly along the entire length of the lacing zone.

To this end, the invention is related to a boot of the type cited above, wherein the lacing zone comprises three tightening sectors, i.e.:

- a first primary tightening sector directed towards the front of the boot, corresponding substantially to the journal zone of the metatarsal bones of the foot and constituting a lower portion of the lacing zone directly biased by a first slack end of the lace or cable during a traction exerted thereon from its free end,
- a second primary tightening sector directed towards the rear of the boot, corresponding substantially to the flexion fold zone of the foot and constituting an upper portion of the lacing zone directly biased by the second slack end of the lace or cable during a traction exerted thereon, the slack ends simultaneously exerting an action on said first and second primary tightening sectors, from their free ends,
- a third secondary tightening sector located between the first and second sectors, corresponding substantially to the instep area and comprising a central portion of the lacing zone, whose tightening is undertaken after that of the first and second zones by progressive transmission of the tractional forces exerted on said slack ends of the lace or cable from their free ends.

BRIEF DESCRIPTION OF THE DRAWINGS

The present invention will be better understood and other characteristics thereof will become clearer upon reading the description that follows, with reference to the annexed schematic drawings illustrating, as non-limiting examples, how the invention can be obtained and wherein:

FIGS. 1 and 2 represent two closure devices by lacing, illustrating prior art;

FIG. 3 is a perspective view of a boot comprising a closure device by lacing as per the invention;

DETAILED DESCRIPTION OF THE PREFERRED EMBODIMENTS

Figure 4:
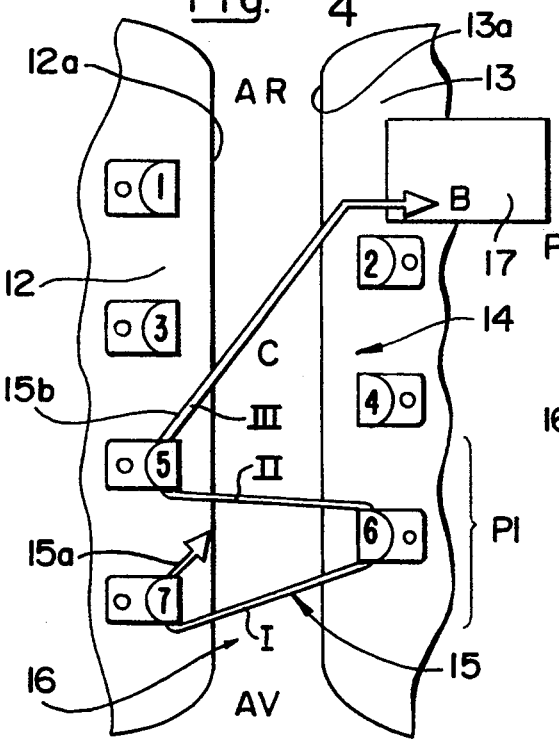
FIGS. 4, 5 and 6 represent a classification of the kinematics of the slack ends of the lace, along the different tightening zones.

The sports boot designated in its entirety and represented in FIG. 3 comprises an external sole 10 on which is mounted an upper 11 open towards the front, to enable passage of the foot and comprises to this end an internal quarter 12 and an external quarter 13 connected to each other by a closure system 14, constituted incidentally by a lace 15 forming two slack ends 15*a* and 15*b* connecting to each other, along a predetermined path, a series of return elements 1 to 7 located in a fixed manner on either side of said quarters 12, 13, in the vicinity of their respective edges 12*a*, 13*a* located across from each other. These edges 12*a*, 13*a* define between themselves a lacing zone 16, such that during an action on the free ends A, B of slack ends 15*a* and 15*b* of lace 15 undertaken via traction means 17, such ends have a tightening effect on quarters 12, 13 via return elements 1 to 7. Thus, said quarters are brought closer to one another and consequently ensure retention of the foot inside the boot.

Figure 5:
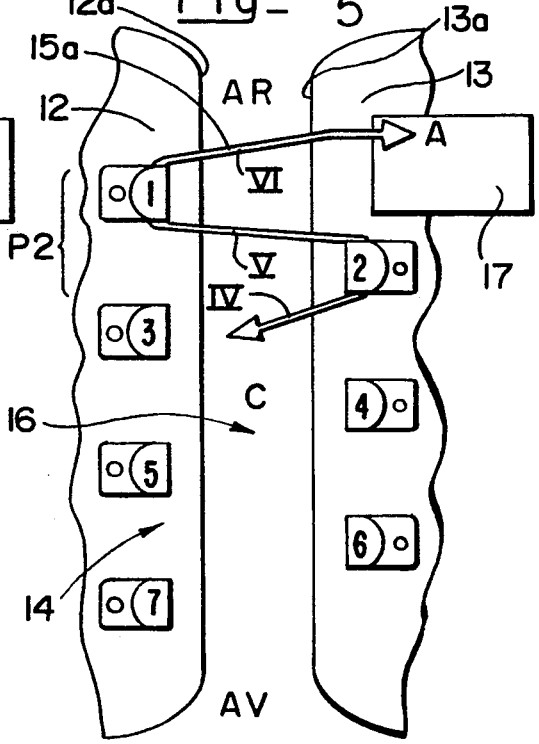
Figure 6:
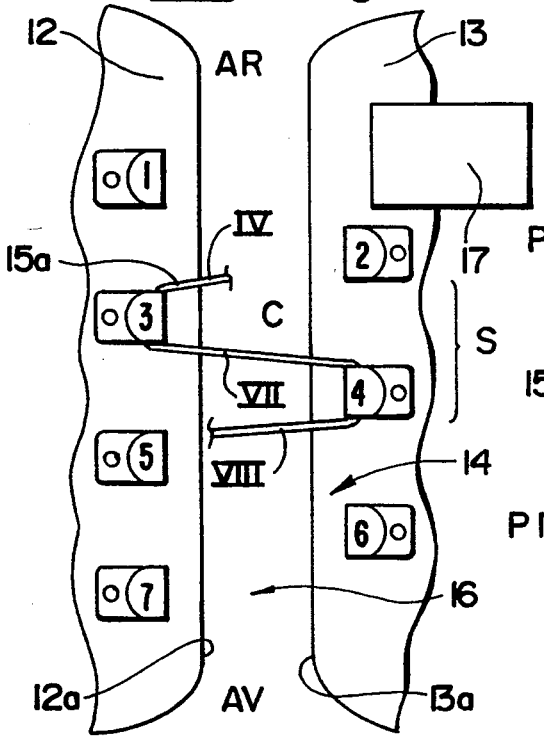
Figure 7:
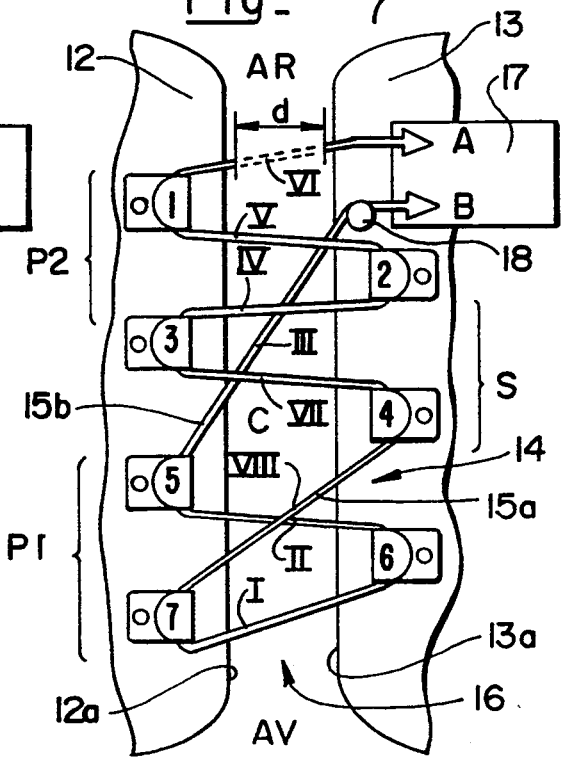
FIG. 7 is a schematic view of a closure device by lacing obtained as per the kinematics of FIGS. 4, 5 and 6.

According to the invention, the lacing zone 16 can be broken down into three tightening sectors, i.e.,

- a first primary tightening sector P1 directed towards the front (AV) of the boot, corresponding substantially to the journal zone of the metatarsal bones of the foot and constituting a lower portion of the lacing zone 16 directly biased by one 15*b* of the slack ends of lace 15 during a traction exerted thereon from its free end B (see FIG. 4),
- a second primary tightening sector P2 directed towards the rear (AR) of the boot, corresponding substantially to the flexion fold zone of the foot and constituting an upper portion of the lacing zone 16 directly biased by the other slack end 15*a* of lace 15 during a traction exerted thereon, the slack ends 15*a*, 15*b* exerting a simultaneous traction on said first and second sectors, respectively P1, P2, for primary tightening, from their free ends A, B (see FIG. 5),
- a third secondary tightening sector S located between the first and second sectors P1, P2, corresponding substantially to the instep zone and constituting a central portion C of the lacing zone 16, whose tightening is undertaken after that of the first and second sectors P1, P2 by a progressive transmission of the tractional forces exerted on the slack ends 15*a* and 15*b* of lace 15 from their free ends A, B (see FIG. 6).

More specifically and as per the present embodiment, the first primary tightening sector P1 comprises at least three return elements 5, 6, 7 of which two 6, 7 located on either side of the internal 12 and external 13 quarters are directed towards the front (AV) of the boot and are connected to each other by an end loop I, common to both slack ends 15*a*, 15*b* of lace 15. The third return element 5 is directed towards the rear (AR) of the boot with respect to the latter elements, and one of the slack ends 15*b* forms, from this return 5 and after having detoured one of the previous elements 6, a double inverted loop I, II, III whose free end B is directly connected to the traction means 17 (see FIG. 4).

In addition, the second primary tightening sector P2 comprises at least two return elements 1, 2 located towards the rear (AR) of said boot on either side of the internal 12 and external 13 quarters of upper 11, and joined to each other by a double inverted loop IV, V, VI formed by one of the slack ends 15A of the lace or cable 15 whose free end A is directly connected to traction means 17 (see FIG. 5).

Further, the third secondary tightening sector S comprises at least two return elements 3, 4 located on either side of the internal 12 and external 13 quarters, in an intermediate zone C, joined to each other by a double inverted loop IV, VII, VIII formed by one of the slack ends 15*a* of the lace or cable 15 (see FIG. 6).

Thus, and to summarize, slack end 15*a* forms, from its free end A, successive loops VI, V, IV, VII, VIII and slack end 15*b* forms, from its free end B, successive loops III, II, I.

As can be deduced from the above, the return elements 1 to 7 are therefore constituted by an odd number, one of the quarters 12 comprising a number n+1 thereof: either four, 1, 3, 5, 7 with respect to the other 13 which comprises a number n thereof: or three, 2, 4, 6. As can be seen in FIGS. 4 to 7, the return elements are located in an offset manner on the quarters across from each other so as to have a substantially horizontal path of loops I, II, . . . VIII.

Figure 8:
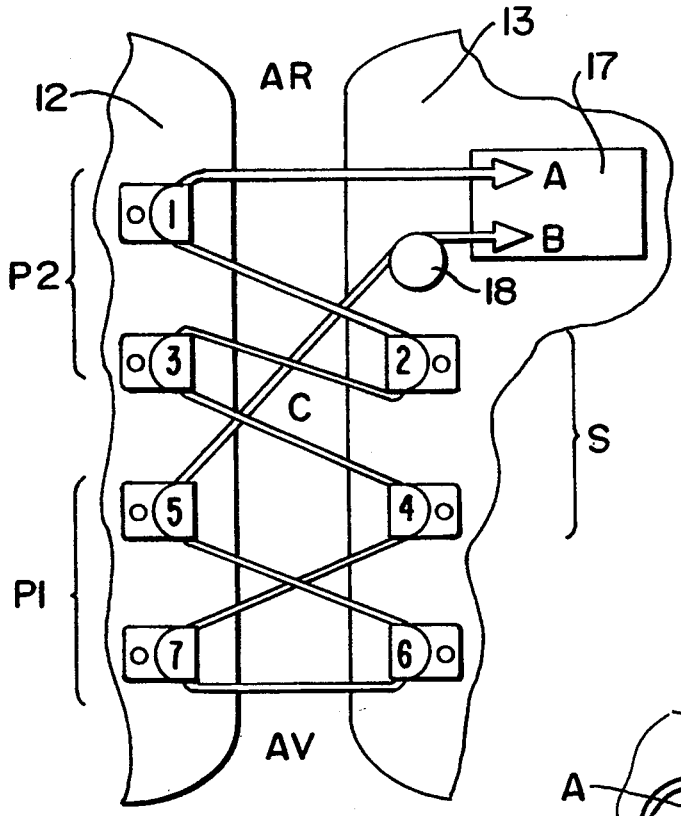
FIGS. 8 and 9 are variations of the embodiment of the invention.

According to the present example, the return elements 1 to 7 are at least seven in number, of which four, 1, 3, 5, 7, are located on one of quarters 12 of upper 11 and three, 2, 4, 6, on the other quarter 13, but as can be seen clearly from FIG. 8, it can be easily envisioned that return elements 3, 5, 7 and 2, 4, 6 of each of quarters 12, 13 of upper 11 could be located across from each other with the exception of one of them 1 directed toward the rear (AR) of the boot.

According to an embodiment, the traction means 17 comprise a mechanical latching device affixed to the boot and activated by a tensioning lever in connection with the free ends A, B of slack ends 15*a*, 15*b* of lace 15.

In this case, a guide element 18 can be provided, affixed to one of quarters 13 comprising n return elements and interposed between the latching device 17 and the first return elements 1, 2 of each of slack ends 15*a*, 15*b* of the lace or cable 15.

Figure 9:
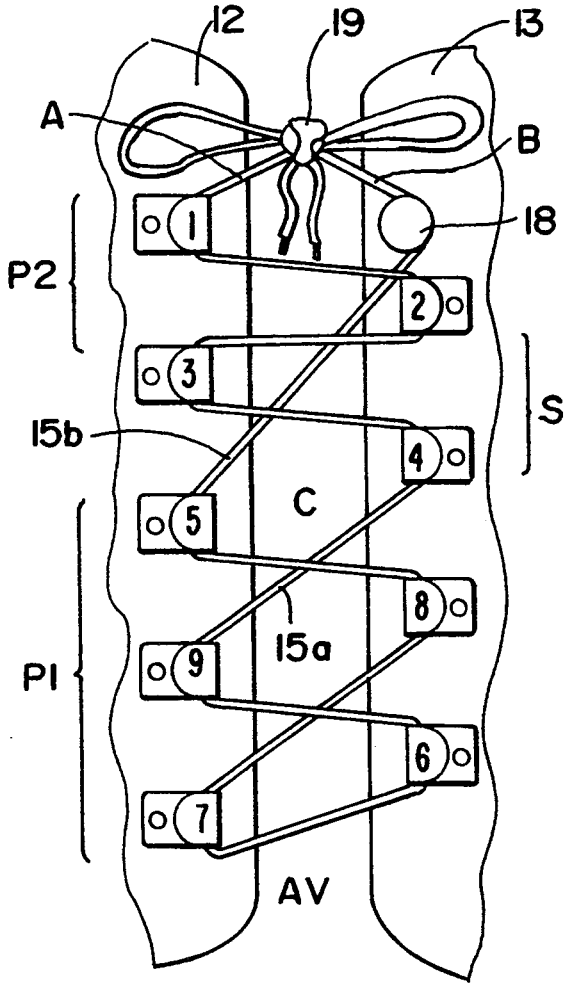

Naturally, as can be seen in FIG. 9, the traction means can also be manual, the immobilizing of slack ends 15*a* and 15*b* of lace 15 being undertaken by a knot 19 formed at ends A, B of said slack ends.

As can also be seen from this drawing, the return elements can also be nine in number, the two additional elements 8, 9 forming a part of the primary tightening P1 here, but they could also be located to form a part of one or the other of tightening zones P2 or S.

According to a variation of the embodiment, the return elements 1 to 9 are studs crimped on quarters 12, 13 of upper 11 and adapted to be detoured by slack ends 15*a* and 15*b* of the lace or cable 15.

According to another variation, the return elements 1 to 9 are eyelets obtained on quarters 12, 13 of upper 11 and adapted to be crossed by slack ends 15*a*, 15*b* of the lace or cable 15.

In all cases, each of the return elements 1 to 9 only bears one slack end 15*a*, 15*b* of the lace or cable 15.

This prevents any intertwining of lace 15 and also enables any excess pressure to be avoided at the level of the foot.

It is understood from the above cited description that the tightening path defined by the lace, with respect to the return elements enables, during latching of the tensioning lever of device 17, to tighten, initially, the two primary tightening zones P1, P2 simultaneously, and then to act on the intermediate secondary zone S.

Thus, when a traction is exerted on slack end 15*a* of lace 15, the lace is displaced for example by a distance "d" (see FIG. 4). Said slack end 15*a* first successively displaces return element 1, then 2, then 3 etc. . . . This results in the displacement of:

element 1 towards 2 and lever 17=primary effect P2,
element 3 towards 2 and 4=secondary effect S.

Simultaneously, slack end 15*b* first successively displaces element 5, then 6, then 7 etc. . . . This results in the displacement of:

element 6 towards 7 and 5 =primary effect P1,
element 4 towards 5 and 3 =secondary effect S.

In view of the fact that slack ends 15*a* and 15*b* are displaced at the same time, the tightening occurs initially at two zones P1, P2, and then at a secondary intermediate zone S.

This enables tightening to be undertaken simultaneously at the front and at the rear of the instep, and then progressively, without any additional force, on the instep. Thus, a bi-active tightening is advantageously obtained.

In addition, the tightening thus obtained enables a more uniform distribution of the tightening tension, and at the same time, this is done very quickly and without any excess pressure at the level of the foot.

Polyamide cables will be used preferably instead of laces for a quicker transmission of the tightening forces and a more efficient and quicker tightening.

The instant application is based upon French patent application 92.13569 of Nov. 6, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A boot comprising:

an external sole, an upper mounted on said sole, said upper being open towards the front to enable passage of the foot and comprising an internal quarter and an external quarter connected to each other by a closure system, said closure system comprising a flexible link, said flexible link extending along a predetermined alternating path, a series of return elements located in a fixed manner on either side of said quarters, in the vicinity of respective edges of said quarters located across from each other and defining a lacing zone, such that when a traction force is exerted on each of the two free ends of the slack ends of the flexible link, the quarters are tightened via return elements to bring said return elements closer to one another and consequently to ensure an internal foot retention, wherein the lacing zone comprises three tightening sectors, said tightening sectors comprising:

a first primary tightening sector directed towards the front of the boot, corresponding substantially to the journal zone of the metatarsal bones of the foot and constituting a lower portion of the lacing zone directly biased by one of the slack ends of the flexible link when traction is exerted thereon from its free end, a second primary tightening sector directed towards the rear of the boot, corresponding substantially to the flexion fold zone of the foot and constituting an upper portion of the lacing zone directly biased by the other slack end of the flexible link when traction is exerted thereon, the slack ends exerting simultaneous traction on said first and second primary tightening sectors, from their free ends and a third secondary tightening sector located between the first and second sectors corresponding substantially to the instep zone and constituting a central portion of the lacing zone, whose tightening is undertaken after tightening of the first and second sectors by progressive transmission of the traction forces exerted on the slack ends of the flexible link from their free ends, wherein the first primary tightening sector comprises at least three return elements, of which at least two are located on either side of the internal and external quarters and directed towards the front of the boot, said at least two return elements being connected to each other by an end loop, said end loop linking both slack ends of the flexible links, a third of said at least three return elements being located behind said at least two return elements and directed towards the rear of the foot with respect to said at least two return elements, said one of the slack ends passing on said third of said at least three return elements and extending directly therefrom to one of said free ends having said traction force exerted thereon.

2. A boot as defined by claim 1, wherein the secondary primary tightening sector comprises at least two return elements located towards the rear of the boot on either side of the internal and external quarters of the upper, and connected to each other by a double inverted loop formed by one of the slack ends of the flexible link whose free end is directly connected to the traction means.

3. A boot as defined by claim 1, wherein the third secondary tightening sector comprises at least two return elements located on either side of the internal and external quarters, in an intermediate zone, joined to each other by a double inverted loop formed by one of the slack ends of the flexible ends.

4. A boot as defined by claim 1, wherein the return elements are odd in number, one of the quarters comprising a number n+1 thereof, with respect to the other which comprises a number n thereof.

5. A boot as defined by claim 4, wherein the return elements are at least seven in number of which four are located on one of the quarters of the upper and three on the other quarter.

6. A boot as defined by claim 1, wherein the return elements of one of the quarters of the upper are offset with respect to those of the other quarter.

7. A boot as defined by claim 1, wherein the return elements of each of the quarters of the upper are located across from each other, with the exception of one of them.

8. A boot as defined by claim 1, wherein the traction means comprise a mechanical latching device affixed to the boot and activated by a tensioning lever in connection with the free ends of the slack ends of the flexible link.

9. A boot as defined by claim 8, wherein a guide element is affixed to one of the quarters comprising n return elements and is interposed between the latching device and the first return elements of each of the slack ends of the flexible link.

10. A boot as defined by claim 1, wherein the traction means are manual, the immobilization of the slack ends of the flexible link being undertaken by a knot.

11. A boot as defined by claim 1, wherein the return elements are studs crimped on the quarters of the upper and adapted to be detoured by the slack ends of the flexible link.

12. A boot as defined by claim 1, wherein the return elements are eyelets obtained on the quarters of the upper and adapted to be crossed by the slack ends of the flexible link.

13. A boot as defined by claim 1, wherein each of the return elements only bears one slack end of the flexible link.

14. A boot as defined by claim 1, wherein the flexible link comprises a cable.

15. A boot as defined in claim 1, further comprising a traction means, said free ends of said flexible link being connected to said traction means, whereby said traction means comprises means for exerting said traction force.

* * * * *